US005267406A

United States Patent [19]

Ruger et al.

[11] Patent Number: 5,267,406

[45] Date of Patent: Dec. 7, 1993

[54] AUTOMATIC PISTOL EJECTOR MOUNTED IN FRAME AND INTERLOCKING WITH HAMMER PIVOT PIN

[76] Inventors: William B. Ruger, Croydon Turnpike, Croydon, N.H. 03773; James McGarry, 880 Douglas La., Prescott, Ariz. 86301

[21] Appl. No.: 973,123

[22] Filed: Nov. 6, 1992

[51] Int. Cl.[5] ..... F41A 15/06; F41A 15/22

[52] U.S. Cl. ..... 42/25; 42/47; 42/70.01

[58] Field of Search ..... 42/20, 25, 46, 47, 48

[56] References Cited

U.S. PATENT DOCUMENTS 1,896,820 2/1933 Jolidon ..... 42/25
4,575,963 3/1986 Roger et al. ..... 42/70.01
4,627,184 12/1986 Roger et al. ..... 42/25

*Primary Examiner*—David H. Brown

[57] ABSTRACT

An ejector mounting arrangement in a pistol frame cavity readily disassembled in which a pivot pin unit includes spring loaded detents engageable in holes in the cavity walls. The holes communicate with the exterior of the pistol so the detents can be pushed into the cavity to allow the ejector and pin unit to drop out. The ejector may also hold the hammer pin in place.

2 Claims, 2 Drawing Sheets

AUTOMATIC PISTOL EJECTOR MOUNTED IN FRAME AND INTERLOCKING WITH HAMMER PIVOT PIN

BACKGROUND OF THE INVENTION

Pistol cartridge ejectors pivotal about pivot pin are old (U.S. Pat. No. 4,627,184) and hammer pivot pins with holding grooves have been proposed (U.S. Pat. No. 4,575,963.

SUMMARY OF THE INVENTION

An automatic pistol having an ejector mounted in a frame handle cavity for rotation around a pin unit having spring loaded projections which project from such cavity into spaced apart passageways. Each passageway communicates with the exterior of the frame to permit insertion of a tool to push a projection back into the recess for disassembly.

It is a feature that the ejector also includes a portion which engages the hammer pin.

DESCRIPTION OF THE PREFERRED EMBODIMENT

Figure 1:
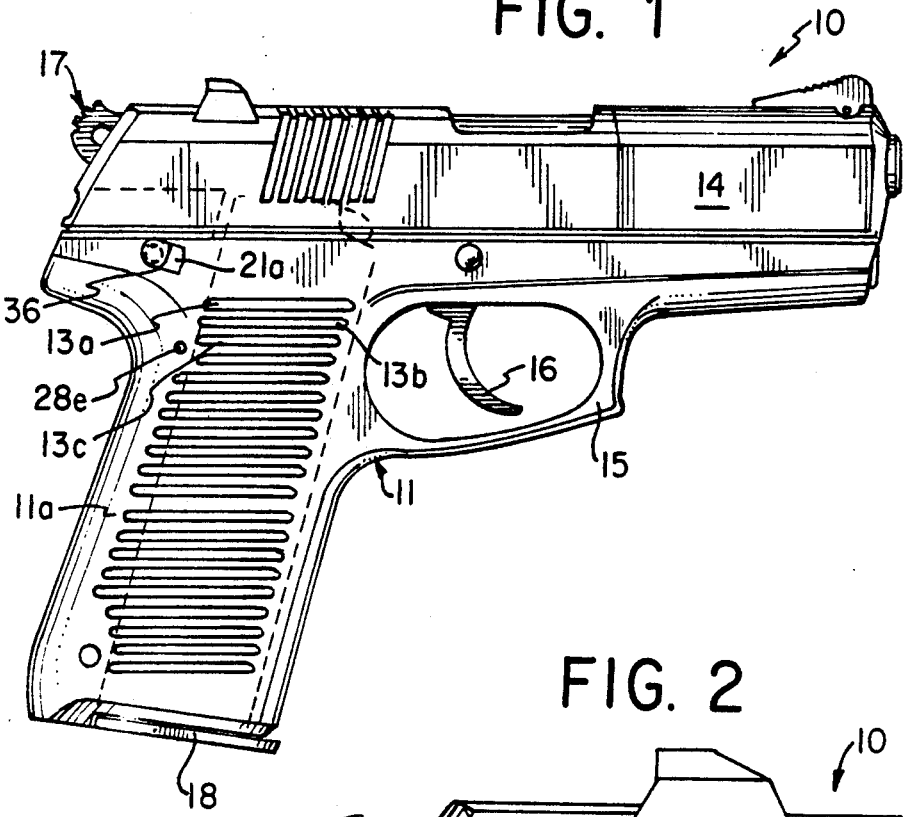
FIG. 1 is a right side elevational view of the pistol of the present invention.
Figure 2:
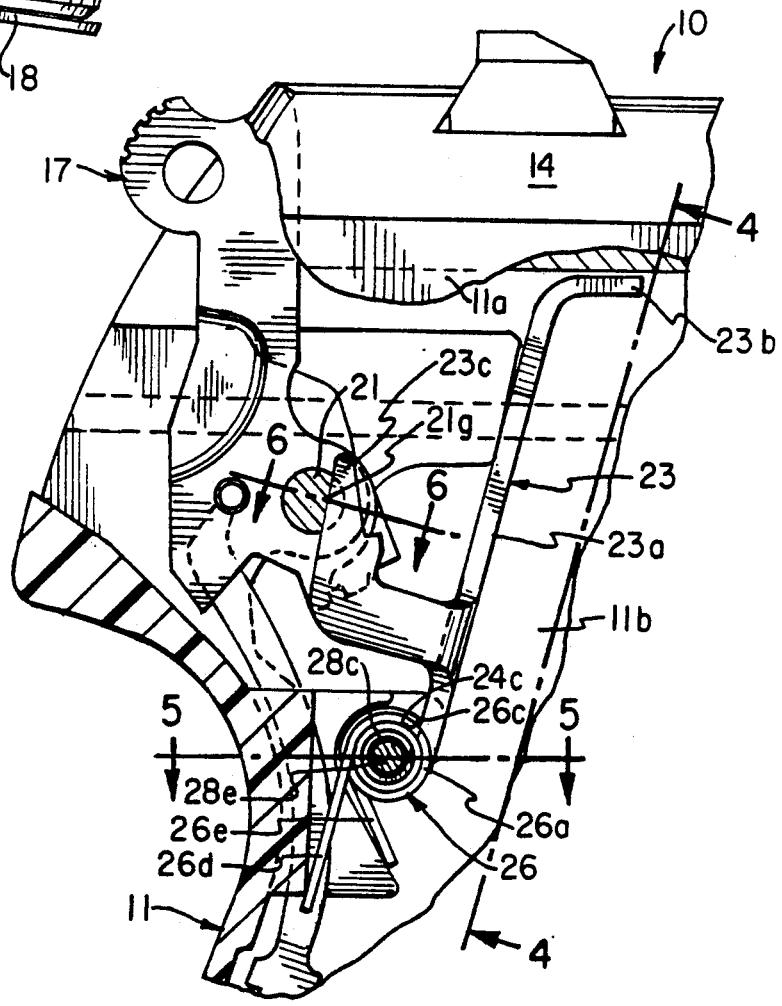
FIG. 2 is a sectional view taken along line 2—2 of FIG. 4.
Figure 3:
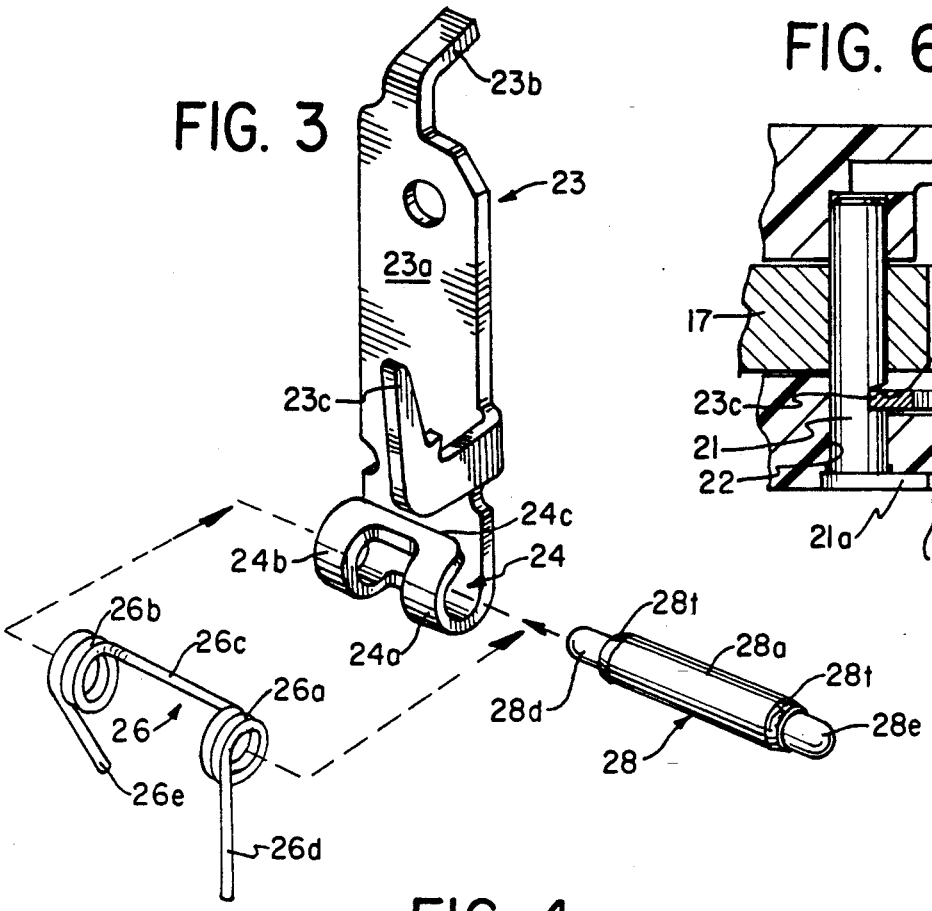
FIG. 3 is an exploded perspective view of the ejector and its spring and pivot unit.
Figure 6:
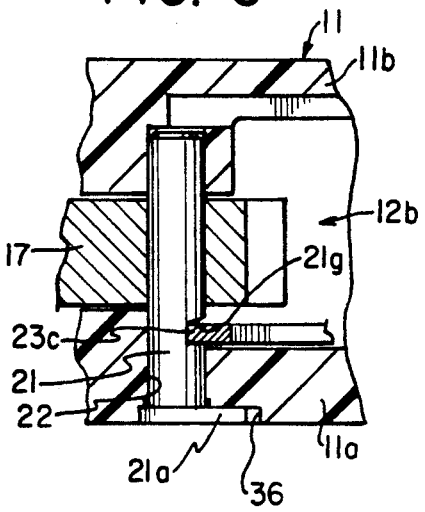
FIG. 6 is a sectional view along line 6—6 of FIG. 2.
Figure 4:
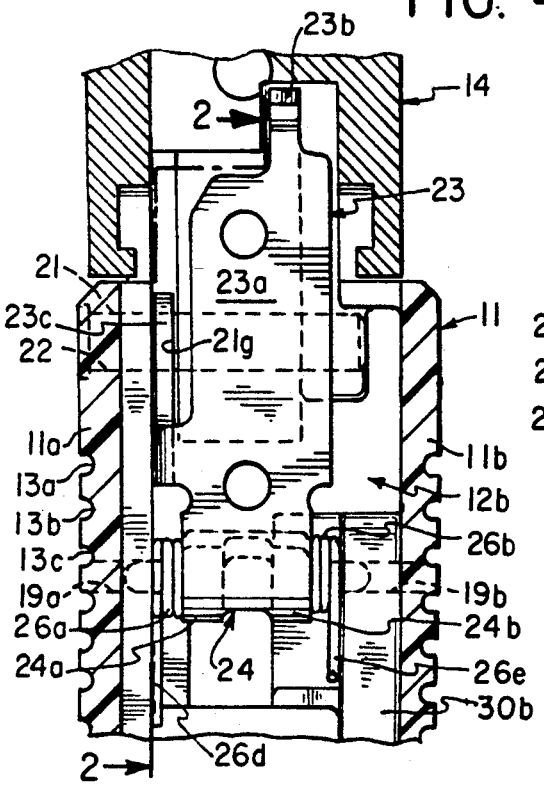
FIG. 4 is a sectional view along line 4—4 of FIG. 2.
Figure 5:
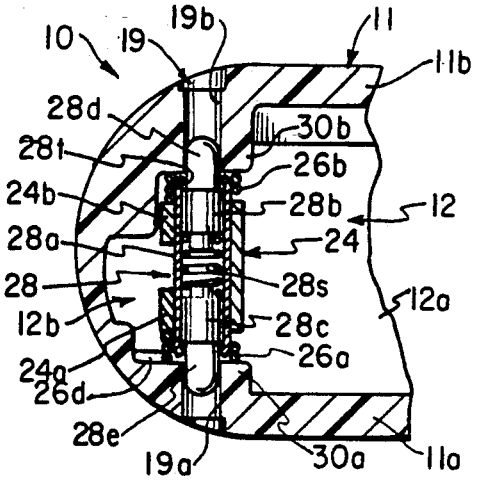
FIG. 5 is a sectional view along line 5—5 of FIG. 2.

In FIGS. 1 and 5, pistol 10 includes a molded plastic frame 11 including left frame side 11*a*, right frame side 11*b* and a frame cavity 12 between walls ll*a*, 11*b*. Frame cavity 12 includes magazine recess portion 12*a* and adjacent rear cavity portion 12*b*. Frame 11 has horizontal grooves 13*a, b, c* on the exterior of each side wall 11*a*, 11*b* and no separate grip panels. Pistol 10 has slide 14, trigger guard 15, trigger 16 and hammer 17. Also shown are magazine 18, a round transverse cylindrical passageway 19 consisting of two (2) aligned spaced-apart passageway sections 19*a*, 19*b*, each of sections 19*a*, 19*b* both communicating with the exterior of frame 11 and frame cavity 12. Above passageway 19*a* is hammer pivot pin 21 in transverse hole 22 (FIGS. 2 and 6). Pin 21 has head 21*a*.

Turning to FIGS. 2–6, ejector 23 includes body 23*a*, cartridge engager portion 23*b*, hammer pin-engaging arm 23*c*, C-shaped pivot unit receiver portion 24 with bearing portions 24*a*, 24*b* and spring seat surface 24*c*. Torsion spring 26 includes coil portions 26*a*, 26*b*, cross piece 26*c* and legs 26*d*, 26*e*. Legs 26*d* and 26*e* are limited in backward movement by frame 11 (FIG. 2). When ejector 23 is pushed forward, spring seat surface 24*c* engages and moves spring cross piece 26*c* forward further tensioning coil portions 26*a*, 26*b* and upon release of ejector 23, the spring 26 urges ejector 23 rearwardly back to its rest position as shown in FIG. 2. Ejector 23, in addition to functioning as a cartridge ejector, engages hammer pivot pin 21 to prevent its transverse movement in pin hole 22. Pin 21 has a slot 21*g* in it for receiving hammer pin-engaging ejector arm 23*c* (FIG. 6).

Turning back to FIG. 5, pivot pin unit 28 include cylindrical body 28*a*, sleeve portions 28*b*, 28*c* mounted within body 28*a*, projectable plungers 28*d*, 28*e* reciprocal in plunger body 28*a* and a coil spring 28*s* for biasing plungers 28*d*, 28*e* outwardly. Outward movement of plungers 28*d*, 28*e* is limited by step surfaces (not shown) on plungers 28*d*, 28*e* and on sleeve portions 28*b*, 28*c*. Unit 28 is mounted in frame cavity 12 having cavity walls 30*a*, 30*b*.

In disassembly of pistol 10, magazine 18 is removed and a tool is inserted from the pistol exterior into passageway 19*a* or 19*b* to push and depress plunger 28*d* or 28*e* until it passes wall 30*a* or 30*b* permitting ejector 23 and unit 28 to drop out of pistol 10.

Finally, in FIGS. 1 and 6, it is seen that hammer pin head 21*a* fits in recess 36 in the exterior of right frame side 11*b* which recess 36 has the same configuration as head 21*a* to prevent turning of hammer pin 21 which assists in preventing transverse movement of pin 21.

We claim:

1. In an automatic pistol having a grip frame, a cartridge ejector and a hammer pin comprising:

1) left and right spaced apart frame walls with aligned pin passageway holes therein;
2) a frame cavity between said walls;
3) a cartridge ejector having a transverse cylindrical opening therethrough and a cartridge engagement portion; and
4) a pin unit for releasably mounting the cartridge ejector in the cavity and said aligned passageway holes in said walls in turn comprising;
   a) a body having two ends;
   b) pin projection means projecting from each end of said body into said aligned holes;
   c) spring means in the housing urging the pin projection means into said holes;

whereby during operation the ejector ejects cartridges and for disassembly the pin projection means are urged by a suitable tool out of one or more pin passageway holes and into the frame cavity for removal of the ejector means and the pin unit.

2. The automatic pistol of claim 1 having in addition a hammer pin and in which the cartridge ejector includes hammer pin engagement means which engage the hammer pin to prevent its transverse movement.

* * * * *